US005123356A

United States Patent [19]

Brooks et al.

[11] Patent Number: 5,123,356

[45] Date of Patent: Jun. 23, 1992

[54] TRANSFER APPARATUS ADAPTED FOR TRANSFERRING AN EXPLOSIVE TRAIN THROUGH AN EXTERNALLY PRESSURIZED SECONDARY EXPLOSIVE BULKHEAD

[75] Inventors: James E. Brooks, Manvel; Daniel C. Markel, Houston, both of Tex.

[73] Assignee: Schlumberger Technology Corporation, Houston, Tex.

[21] Appl. No.: 725,369

[22] Filed: Jun. 27, 1991

Related U.S. Application Data

[63] Continuation-in-part of Ser. No. 569,873, Aug. 17, 1990, abandoned.

[51] Int. Cl.[5] ..... C06C 5/06

[52] U.S. Cl. ..... 102/275.12; 102/202.14; 102/275.4; 102/275.6; 102/275.11

[58] Field of Search ..... 102/275.1, 275.2, 275.3, 102/275.4, 275.5, 275.6, 275.7, 275.8, 275.9, 275.12, 318, 322, 202.6, 202.12, 202.14, 202.5, 275.11; 89/1.15

[56] References Cited

U.S. PATENT DOCUMENTS

| | | | |
|---|---|---|---|
| 697,842 | 4/1902 | Hoover | 102/275.9 |
| 1,719,065 | 7/1929 | Mallet | 102/275.4 |
| 2,253,549 | 8/1941 | Barton | 102/275.5 |
| 2,739,535 | 3/1956 | Rolland et al. | 102/202.6 |
| 3,008,411 | 11/1961 | Conrad | 89/1.15 |
| 3,082,689 | 3/1963 | Griffith et al. | 102/318 |
| 3,212,439 | 10/1965 | Reyne | 102/202.14 |
| 3,244,103 | 4/1966 | Spickard | 102/202.5 |
| 3,401,632 | 9/1968 | Griffith et al. | 102/318 |
| 3,831,522 | 8/1974 | Romney | 102/318 |
| 4,248,152 | 2/1981 | Yunan | 102/275.4 |
| 4,649,822 | 3/1987 | Seeman | 102/275.1 |
| 4,716,832 | 1/1988 | Sumner | 102/275.1 |
| 4,762,067 | 8/1988 | Barker et al. | 102/202.7 |
| 4,998,477 | 3/1991 | Barker | 102/275.6 |
| 5,009,163 | 4/1991 | Robins et al. | 102/275.12 |

FOREIGN PATENT DOCUMENTS

| | | | |
|---|---|---|---|
| 24419 | 5/1936 | Australia | 102/275.12 |
| 891012 | 1/1972 | Canada | 102/322 |
| 990138 | 6/1976 | Canada | 102/202.5 |
| 13247 | of 0000 | United Kingdom | 102/275.9 |

*Primary Examiner*—Stephen Johnson

*Attorney, Agent, or Firm*—Henry N. Garrana; John H. Bouchard

[57] ABSTRACT

A transfer unit is sealingly connected to a pressure tight housing. The pressure tight housing includes a detonator and electronics circuits connected to the detonator, the pressure tight housing being adapted to be disposed in a well apparatus situated in a wellbore. The wellbore contains fluids at high temperature and pressure, and the pressure tight housing protects the detonator and electronics from the severe temperature and pressure of the wellbore fluids. The transfer unit receives, on one end, the detonator and, on the other end, a separate detonating cord which is adapted to be connected to another separate explosive device and includes a pressure proof housing and a matrix of secondary explosive disposed in a compressed condition within the pressure proof housing between the detonator and the detonating cord, the matrix of secondary explosive functioning like a transversely disposed bulkhead or barrier for protecting the detonator and associated electronics from the severe temperature and pressure of the wellbore fluids which exists adjacent the detonating cord. Although the secondary explosive bulkhead is compressed within the pressure proof housing, the detonating cord may penetrate the secondary explosive bulkhead in response to the high pressure of the external wellbore fluids. Therefore, in order to prevent this penetration, the pressure proof housing includes a neck down portion disposed peripherally around the secondary explosive bulkhead in order to further compress the secondary explosive and to prevent the detonating cord from penetrating the secondary explosive bulkhead in response to the high pressure of the wellbore fluids.

7 Claims, 2 Drawing Sheets

TRANSFER APPARATUS ADAPTED FOR TRANSFERRING AN EXPLOSIVE TRAIN THROUGH AN EXTERNALLY PRESSURIZED SECONDARY EXPLOSIVE BULKHEAD

This is a continuation-in-part of application Ser. No. 07/569,873 filed Aug. 17, 1990 now abandoned.

BACKGROUND OF THE INVENTION

The subject matter of the present invention relates to a transfer unit for reliably transferring an explosive train from inside a pressure tight housing, through an externally pressurized bulkhead, to explosive devices disposed outside the housing which are exposed to the pressure and temperature of downhole borehole fluids.

One persistent problem which exists in wireline and tubing conveyed perforating is the lack of a reliable transfer of a strong detonation wave from one in-line explosive device to another, such as from a blasting cap to a detonating cord, from a booster to a detonating cord, or from detonating cord to booster. Transfer units are used to provide the detonation wave transfer. In typical prior art transfer units, the detonating cord abuts against the explosive interface of the booster or blasting cap. In these prior art transfer units, the transfer of a strong detonation wave is reliable provided the detonating cord abuts against the explosive interface. In fact, a reliable transfer can occur even though a small gap or space exists between the detonating cord and the explosive interface. The transfer is not reliable and may not occur, however, if the gap is large or if the end of the detonating cord is improperly prepared; this is particularly true if the transfer is from a detonating cord to a booster where shrinkage of the detonating cord has caused the inner core of the detonating cord to withdraw from the booster interface.

In addition, it is often necessary to interconnect two or more perforating guns to each other at a well site. When this is necessary, one must string a detonating cord, in series fashion, through each perforating gun in a tubing string. Since this task must be accomplished at the well site, it is a very time consuming task. It would be more convenient and far less time consuming for well site personnel if the detonating cord could be disposed in each perforating gun individually at its field shop, and adjacent perforating guns could be interconnected together at the well site by simply interconnecting their respective detonating cords. Furthermore, for perforating applications downhole, it is often desirable to initiate an explosive detonation train from inside a pressure-tight housing and to effect a transfer of the explosive train to explosive devices disposed outside the housing, which explosive devices are exposed to the pressure and temperature of downhole fluids. Since the explosive train is initiated by a detonator and electronics disposed inside the housing, the pressure-tight housing protects the detonator and electronics from the pressure and temperature of the downhole fluids. Conversely, it may also be necessary to transfer an explosive detonation train from a severe pressure and temperature environment disposed outside of the housing to the inside of the pressure tight housing in order to activate electrical or mechanical devices disposed inside the housing. Most typical detonation train transfer devices require the detonation train to transfer across a thick, pressure-tight transversely disposed metallic barrier or bulkhead, which bulkhead weakens the detonation train. As a result, the detonation train does not always transfer successfully across the bulkhead. When detonating from inside the pressure tight housing the problem is further aggravated by the pressure of the downhole wellbore fluid acting on the receptor explosive disposed outside of the housing. The fluid pressure makes the receptor explosive less sensitive to being detonated buy the donor explosive detonation train attempting to transfer across the bulkhead.

SUMMARY OF THE INVENTION

Accordingly, it is a primary object of the present invention to provide a high reliability transfer unit for transferring a strong detonation wave between one explosive device and another explosive device.

It is a further object of the present invention to provide a high reliability transfer unit which includes at least two transfer paths for the detonation wave during its transfer between the one explosive device and another explosive device.

It is a further object of the present invention to provide a high reliability transfer unit which includes at least two transfer paths, one path being a standard end-to-end transfer path, the other path being a transverse transfer path.

It is a further object of the present invention to provide a high reliability transfer unit which includes a standard end to end transfer path and a transverse transfer path, the transverse path being provided by extending a booster explosive so that it encompasses a portion of a detonating cord.

It is a further object of the present invention to provide a transfer unit which utilizes the two detonation wave transfer path principle between detonating cord and booster; however, the transfer unit is also adapted to interconnect together two detonating cords associated with two adjacent apparatus, such as two adjacent perforating guns.

It is a further object of the present invention to enable well site personnel to more easily and more conveniently interconnect together detonating cords of adjacent perforating guns at the well site by providing a transfer unit which allows the detonating cords of adjacent perforating guns to be easily plugged into both sides of the transfer unit thereby allowing the detonating cords to be disposed in the perforating guns at the field shop rather than at the well site, the transfer unit utilizing the two detonation wave transfer path principle for more reliably transferring a detonation wave from a detonating cord to a booster disposed within the transfer unit. It is a further object of the present invention to provide a high reliability explosive detonation train transfer unit which transfers an explosive detonation train from a point inside a pressure tight housing of the transfer unit to a point outside the housing, the transfer unit including, in lieu of the transversely disposed metallic bulkhead, a bulkhead or barrier made of another explosive which has a particular geometric configuration.

These and other objects of the present invention are accomplished by providing a high reliability transfer unit for transferring a strong detonation wave between one explosive device and another. If the one device is a detonating cord, and the other is a booster, the high reliability is achieved by providing at least two transfer paths, a standard end-to-end detonating cord/booster interface transfer path, and a transverse path. The transverse path is provided by extending the booster explosive around the detonating cord so that it encompasses a portion of the detonating cord, for example, the last one-half inch of the detonating cord. If a gap should occur at the end to end interface between the detonating cord and the booster, a detonation wave transfer would still take place along the transverse path thereby creating a sideways detonation of the detonating cord and the booster. In addition, a further transfer unit such as above described may include two ends, each end adapted for interconnecting a detonating cord of an apparatus (e.g., a perforating gun) to a booster contained within the transfer unit, the booster being extended over each detonating cord of each apparatus so as to create two transverse transfer paths, one transverse path being associated with one detonating cord/booster interface, and one transverse path being associated with the other detonating cord/booster interface. The further transfer unit would allow a detonating cord to be disposed in a perforating gun at its field shop, and well site personnel need only to interconnect one detonating cord associated with one perforating gun to another detonating cord associated with another perforating gun via the further transfer unit. In another embodiment of the present invention, a transfer unit is sealingly connected to a pressure tight housing. The pressure tight housing includes a detonator and electronics circuits connected to the detonator, the pressure tight housing being adapted to be disposed in a well apparatus situated in a wellbore. The wellbore contains fluids at high temperature and pressure. The pressure tight housing protects the detonator and electronics from the severe temperature and pressure of the wellbore fluids. The transfer unit receives, on one end, the detonator and receives, on the other end, a separate detonating cord which is adapted to be connected to another separate explosive device. An explosive train is initiated in the detonating cord from the detonator, and propagates to the separate explosive device. The transfer unit includes: (1) its own pressure proof housing for receiving, on one end, the detonator and for receiving, on the other end, the detonating cord; and (2) a matrix of secondary explosive disposed in a compressed condition within the pressure proof housing between the detonator and the detonating cord, the matrix of secondary explosive functioning like a transversely disposed bulkhead or barrier (hereinafter called the "secondary explosive bulkhead") for protecting the detonator and associated electronics from the severe temperature and pressure of the wellbore fluids which exists adjacent the detonating cord. The secondary explosive bulkhead replaces a previously used metallic bulkhead. Although the secondary explosive bulkhead is compressed within the pressure proof housing, the detonating cord may penetrate the secondary explosive bulkhead in response to the high pressure of the external wellbore fluids. Therefore, in order to prevent this penetration of the secondary explosive bulkhead, the pressure proof housing of the transfer unit includes a neck down portion disposed peripherally around the secondary explosive bulkhead in order to further compress the secondary explosive disposed between the detonator and the detonating cord and to prevent the detonating cord from penetrating the secondary explosive bulkhead in response to the high pressure of the wellbore fluids.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein.

DETAILED DESCRIPTION OF THE PREFERRED EMBODIMENT

Figure 1A:
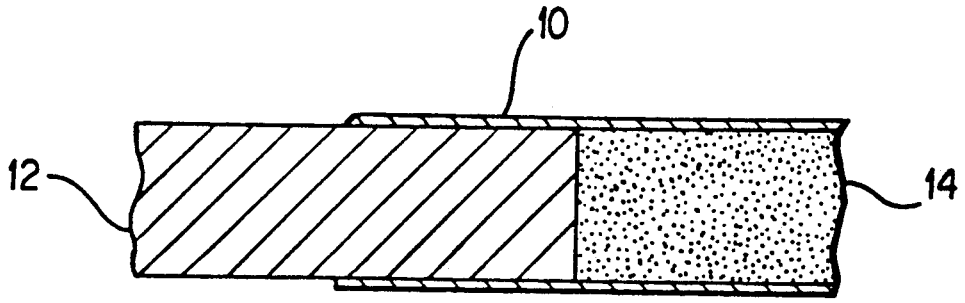
FIG. 1a (PRIOR ART)
FIG. 1*a* illustrates a reliable prior art transfer of a detonation wave from a detonating cord to a booster.

Referring to FIG. 1*a*, a transfer unit of the prior art is illustrated. In FIG. 1*a*, a metallic containment shell 10 encloses a detonating cord 12 and a booster explosive 14. FIG. 1*a* illustrates a reliable transfer between the detonating cord 12 and the booster 14, since an end of the detonating cord 12 is disposed in contact with an end of the booster 14.

Figure 1B:
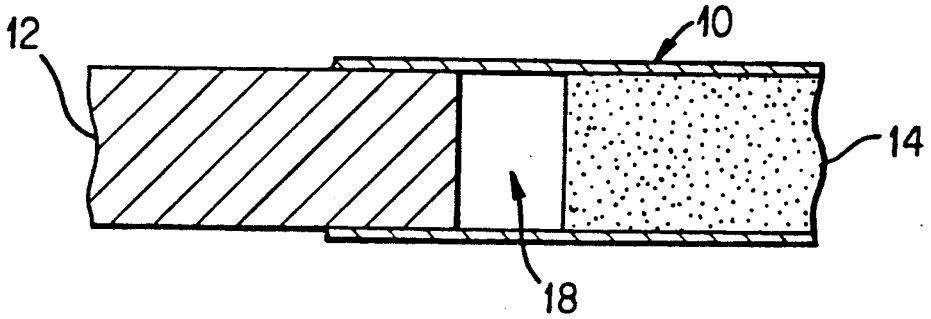
FIG. 1b (PRIOR ART)
FIG. 1*b* illustrates an unreliable prior art transfer of the detonation wave of FIG. 1*a;*

Referring to FIG. 1*b*, the transfer unit of FIG. 1*a* is illustrated, this figure illustrating an unreliable transfer between the detonating cord 12 and the booster 14 in view of a gap 18 which exists between the detonating cord 12 and the booster 14. The gap 18 has a tendency to prevent a detonation wave, propagating within the detonating cord 12, from transferring to booster 14.

Figure 2:
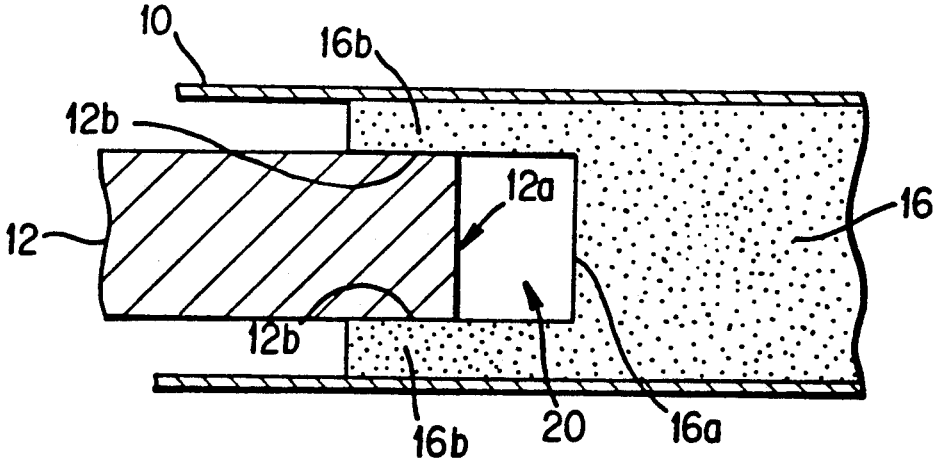
FIG. 2 illustrates a transfer unit embodying the two transfer path principle in accordance with one aspect of the present invention.

Referring to FIG. 2, a transfer unit in accordance with the present invention is illustrated. In FIG. 2, a metallic containment shell 10 encloses a detonating cord 12, as in FIGS. 1*a* and 1*b*. However, a new booster 16 is also enclosed by shell 10, the new booster 16 including an end-to-end section 16*a* and two transverse (or extension) sections 16*b*, the transverse or extension section 16*b* extending longitudinally of the end-to-end section 16*a*, the end-to-end section 16*a* being adapted to contact an end 12*a* of detonating cord 12, the transverse section 16*b* being adapted to contact an outer periphery 12*b* of detonating cord 12. As a result, the booster 16 is extended around the detonating cord 12 so as to encompass a portion of the detonating cord, e.g., the last one-half inch of the detonating cord. Consequently, two transfer paths are created: one transfer path being a standard end-to-end transfer path defined by an interface between end-to-end section 16*a* of booster 16 and end 12*a* of detonating cord 12; the other transfer path being a transverse transfer path defined by an interface between transverse (or extension) section 16*b* of booster 16 and the outer periphery 12*b* of the portion (i.e., last one-half inch) of the detonating cord 12.

In operation, referring to FIG. 2, if a large gap 20 exists between end 12*a* of detonating cord 12 and end-to-end section 16*a* of booster 16*a*, a strong detonation wave will nevertheless reliably transfer between detonating cord 12 and booster 16 via the transverse transfer path defined by the interface between transverse section 16*b* of booster 16 and the outer periphery 12*b* of the portion (e.g., last one-half inch) of the detonating cord 12.

Figure 3:
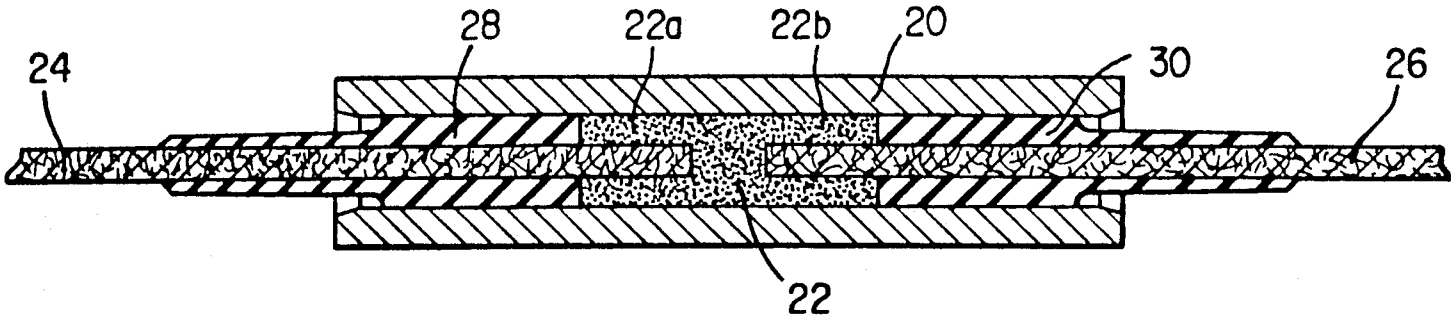
FIG. 3 illustrates a further transfer unit embodying the two transfer path principle of FIG. 2, a two-transfer path principle being functionally provided at each end of the further transfer unit.

Referring to FIG. 3, another transfer unit in accordance with another embodiment of the present invention is illustrated.

In FIG. 3, the transfer unit includes a pressure housing 20 enclosing a matrix explosive 22, a first detonating cord 24, and a second detonating cord 26. The first detonating cord 24 is enclosed by a boot seal 28. The second detonating cord 26 is enclosed by a boot seal 30. The matrix explosive 22 extends around the end of the first detonating cord 24 and the second detonating cord 26 so as to encompass a portion (e.g., the last one-half inch) of the first and second detonating cords 24 and 26, in the same manner as described with reference to FIG. 2 of the drawings, thereby creating an end-to-end transfer path between first detonating cord 24 and matrix explosive 22 and between second detonating cord 26 and matrix explosive 22 and also creating a transverse transfer path between a transverse section 22*a* of matrix explosive 22 and an outer periphery of the first detonating cord 24 and between a transverse section 22*b* of matrix explosive 22 and an outer periphery of second detonating cord 26.

In operation, the transfer unit of FIG. 3 may be used at a well site when a plurality of perforating guns are serially connected to an end of a tubing string. Normally, when perforating guns are serially connected together at the well site, for safety reasons, it is necessary for well site personnel to string a detonating cord manually within and among each serially connected perforating gun in the tubing string. This may be a very time consuming task for well site personnel. It would be more advantageous to string a detonating cord in a perforating gun at a field shop, and then merely interconnect together adjacent detonating cords of serially connected perforating guns at the well site. However, to date, no transfer unit exists which would allow the adjacent detonating cords to be interconnected together. If such a transfer unit does exist, it probably does not possess the transverse transfer path and the end-to-end transfer path for producing a more reliable transfer of a strong detonation wave, as described above with reference to FIGS. 2 and 3 of the drawings. In view of the transfer unit of FIG. 3, perforating guns may now be manufactured with detonating cords already disposed therein, or the detonating cords may disposed in the perforating guns at the field shop; and, when it is necessary to interconnect adjacent perforating guns to a tubing at a well site, well site personnel need merely interconnect adjacent detonating cords of adjacent, serially connected perforating guns together by plugging the adjacent detonating cords into the transfer unit of FIG. 3. In addition, since a transverse transfer path (as well as an end-to-end transfer path) exists between transverse sections 22*a*, 22*b* of matrix explosive 22 and an outer periphery of first and second detonating cords 24 and 26, a strong detonation wave will now more reliably propagate at least along the transverse transfer path if not also along the end-to-end transfer path between detonating cord 24, 26 and matrix explosive 22.

Figure 4:
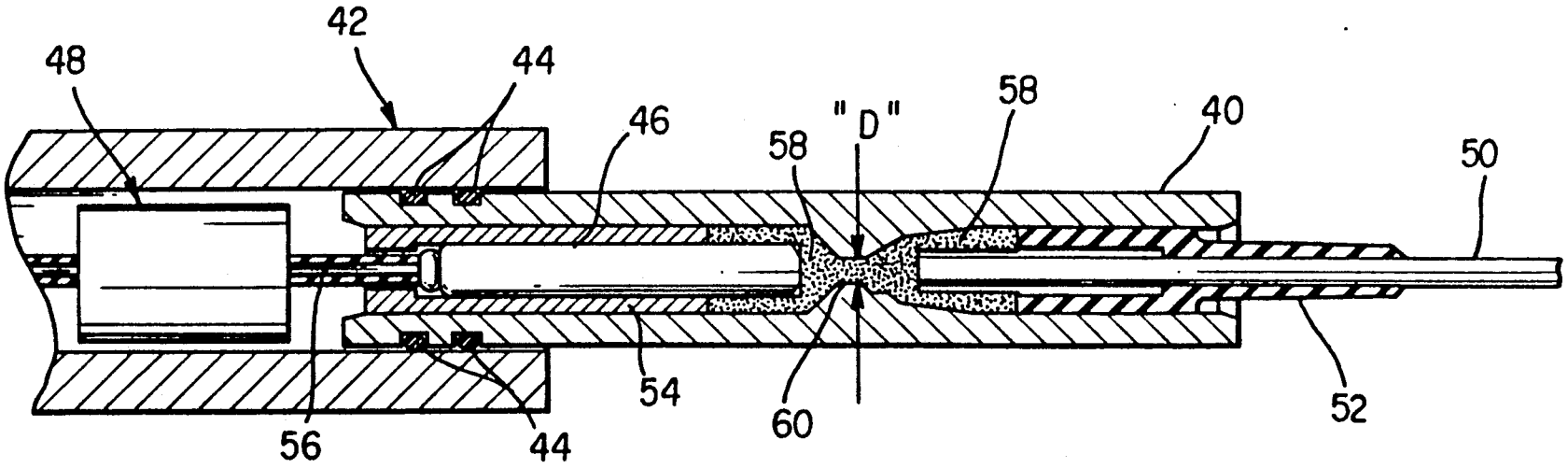
FIG. 4 illustrates another embodiment of the transfer unit in accordance with the present invention.

Referring to FIG. 4, another embodiment of the transfer unit in accordance with the present invention is illustrated.

In FIG. 4, the transfer unit is adapted to be disposed in a well apparatus, such as a perforating apparatus, that is situated in a wellbore containing a fluid under high temperatures and pressures. The transfer unit is adapted to plug into a firing head of the perforating apparatus for connecting a detonator of the firing head to a separate detonating cord. The separate detonating cord may, for example, be connected to a plurality of shaped charges in the perforating apparatus.

The transfer unit includes a pressure proof housing 40 sealingly connected to a pressure tight housing 42 of another apparatus. The pressure tight housing 42 may, for example, be the housing associated with the firing head of the perforating apparatus. A pair of O-rings 44 seal the pressure proof housing 40 to the pressure tight housing 42. The pressure tight housing 42 houses an initiating means, such as a detonator 46 and electronic circuits 48 connected to the detonator 46. The detonator 46 is received in one end of the pressure proof housing 40. A separate receptor 50, such as a detonating cord 50, is received in the other end of the pressure proof housing 40. The detonating cord 50 may, for example, be connected to a plurality of shaped charges of the perforating apparatus. A sealing boot 52 seals the detonating cord 50 from the severe temperatures and pressures of the wellbore fluid which exist around the periphery of the detonating cord 50. A separate metallic retaining shell 54 encloses the detonator 46. An insulated electrical conductor 56 connects the electronics 48 to the detonator 46 for delivering a current to the detonator thereby detonating the detonator 46. A matrix of secondary explosive 58 is disposed within the pressure proof housing 40 and in a space between the detonator 46 and the detonating cord 50. The secondary explosive matrix 58 surrounds the end of detonator 46 and surrounds the end of detonating cord 50 to provide an end-to-end and a transverse transfer path for the detonation train as described and illustrated with reference to FIG. 3 of the drawings. The matrix of secondary explosive 58 functions like a transversely disposed bulkhead or barrier (hereinafter called "secondary explosive bulkhead 58") for protecting the detonator 46 and electronics 48 from the severe temperature and pressure of the wellbore fluid which exists in the wellbore around the detonating cord 50. The secondary explosive bulkhead 58 is compressed into the pressure proof housing 40, the pressed density of the secondary explosive bulkhead 58 being typically 1.1 g/cc to 1.5 g/cc, which is the optimal range for detonation initiation sensitivity.

Since severe wellbore pressures exist around the detonating cord 50, unless the secondary explosive bulkhead 58 is compressed tightly enough, the detonating cord 50 may penetrate the secondary explosive bulkhead. If this happens, the severe temperatures and pressures of the wellbore fluid may adversely affect the performance of the detonator 46 and/or the electronics 48. Consequently, the structural integrity of the secondary explosive bulkhead 58 is a very important consideration. If the secondary explosive bulkhead 58 is pressed to a very high density, or is made with a suitable binder to give it high material strength, the secondary explosive bulkhead 58 may, by itself, withstand the high pressure of the wellbore fluid surrounding the detonating cord 50.

Normally, however, if the secondary explosive bulkhead 58 is pressed to low densities to yield better initiation, the material shear strength of the secondary explosive bulkhead 58 is not sufficient to prevent the detonating cord 50 from penetrating the secondary explosive bulkhead in response to the high pressures of the wellbore fluid surrounding the detonating cord 50. Therefore, in order to provide additional support for the secondary explosive bulkhead 58 in preventing penetration of the bulkhead 58 by detonating cord 50, the pressure proof housing 40 includes a neck down portion 60 integrally connected to the housing 40 and surrounding the periphery of the secondary explosive bulkhead 58. The neck down portion 60 has a tip; and the distance "D" from the tip of one neck down portion 60 to the tip of an oppositely disposed neck down portion 60 is less than the diameter of the detonating cord 50. As a result, if the detonating cord 50 attempts to penetrate the secondary explosive bulkhead 58, and if the pressed density of the bulkhead secondary explosive 58 is not enough to prevent the penetration of the bulkhead 58 by detonating cord 50, the neck down portion 60 of the pressure proof housing 40 (and, in particular, the distance "D" between tips of the oppositely disposed neck down portions 60) will prevent the detonating cord from penetrating the bulkhead 58.

It will be obvious, however, that, in lieu of a neck down portion 60, other configurations are possible for providing additional support to the secondary explosive bulkhead 58 in preventing penetration of the bulkhead by the detonating cord 50; for example, rough surfaces, or sudden or gradual changes in cross sectional area around the secondary explosive bulkhead 58 may also provide the required additional support.

In operation, referring to FIG. 4, assume that the detonating cord 50 is connected to a plurality of shaped charges in a perforating gun and that the detonator 46 and associated electronics 46 are part of a firing head connected to the perforating gun. The firing head is lowered into the wellbore with the perforating gun. The intent is to detonate the perforating gun. Since the wellbore may contain wellbore fluid at high temperatures and pressures, the detonating cord 50 and boot seal 52 are exposed to the high temperatures and pressures of the wellbore fluid. If the wellbore fluid leaks into the area surrounding the detonator 46 and electronics 48, the wellbore fluid may adversely affect the performance of the detonator 46. Consequently, the detonator 46 and electronics 48 must be protected from the wellbore fluid. Therefore, in order to provide this protection, the pressure proof housing 40 is sealed to the pressure tight housing 42 via the O-ring seals 44. In addition, the secondary explosive bulkhead 58 and sealing boot 52 separate and further protect the detonator 46 and electronics 48 from the high temperatures and pressures of the wellbore fluid. Furthermore, the secondary explosive bulkhead 58 completely surrounds the end of detonator 46 and the end of detonating cord 50 thereby providing both an end-to-end transfer path and a transverse transfer path for the explosive detonation train propagating between the detonator and the detonating cord. In addition, if, in response to the high pressure of the wellbore fluid, the detonating cord 50 attempts to push inwardly toward detonator 46 and penetrate the bulkhead 58, since the distance "D" between oppositely disposed tips of the neck down portion 60 is less than the diameter of the detonating cord 50, the neck down portion 60 prevents the detonating cord 50 from successfully penetrating the bulkhead 58. Therefore, the wellbore fluids will not be able to penetrate the secondary explosive bulkhead 58 and adversely affect the performance of the detonator 46 and electronics 48. In operation, the electronics 48 of the firing head sends an electrical signal down conductor 56 to detonator 46; the detonator 46 detonates, igniting the secondary explosive bulkhead 58, and initiating the propagation of a detonation train in the detonating cord 50, the detonation train propagating in detonating cord 50 to the shaped charges in the perforating gun, detonating the charges.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A transfer unit adapted to be sealingly connected a first housing, the first housing enclosing an initiating means for initiating a detonation train, comprising:

a second housing having a first end adapted to be sealingly connected to said first housing and a second end, said first end receiving said initiating means, said second end receiving a receptor; and a compressed explosive disposed within said second housing between said initiating means and said receptor, said explosive abutting against an end of said initiating means and an end of said receptor and completely surrounding a periphery of said initiating means and a periphery of said receptor, the compressed condition of said explosive sealingly isolating said initiating means from said receptor, said second housing including a penetration means for preventing said receptor from penetrating said explosive when said receptor attempts to move longitudinally through said second housing toward said initiating means, said penetration prevention means including a neck down portion surrounding a periphery of said explosive.

2. A firing head, comprising:

a detonator;

a first pressure tight housing adapted for enclosing said detonator;

a detonating cord;

a transfer unit adapted to be connected between said detonator and said detonating cord, said transfer unit including, a second pressure tight housing having a first end and a second end, the first end adapted to receive said detonator and sealingly connect to said first pressure tight housing when the detonator is received in said first end, the second end adapted to receive said detonating cord, and a compressed explosive disposed between said detonator and said detonating cord within said second pressure tight housing, said explosive abutting against an end of said detonator and an end of said detonating cord and completely surrounding a periphery of said detonator and a periphery of said detonating cord, said second pressure tight housing of said transfer unit including penetration prevention means for preventing said detonating cord from penetrating said explosive when said detonating cord attempts to move longitudinally through the second housing toward said detonator, said penetration prevention means including a neck down portion surrounding a periphery of said explosive.

3. The firing head of claim 2, further comprising:

further sealing means for providing a fluid tight seal between said detonating cord and said second end of said second housing.

4. A transfer unit adapted to be sealingly connected to a first housing, the first housing enclosing an initiating means for initiating a detonation train, comprising:

a second housing having a first end adapted to be sealingly connected to said first housing and a second end, said first end receiving said initiating means, said second end receiving a receptor; and a compressed explosive disposed within said second housing between said initiating means and said receptor, said explosive abutting against an end of said initiating means and an end of said receptor and completely surrounding a periphery of said initiating means and a periphery of said receptor, the compressed condition of said explosive sealingly isolating said initiating means from said receptor, said second housing including a penetration prevention means for preventing said receptor from penetrating said explosive when said receptor attempts to move longitudinally through said second housing toward said initiating means.

5. The transfer unit of claim 4, wherein said penetration prevention means includes a neck down portion surrounding a periphery of said explosive.

6. A firing head, comprising:

a detonator;

a first pressure tight housing adapted for enclosing said detonator;

a detonator cord;

a transfer unit adapted to be connected between said detonator and said detonating cord, said transfer unit including, a second pressure tight housing having a first end and a second end, the first end adapted to receive said detonator and sealingly connect to said first pressure tight housing when the detonator is received in said first end, the second end adapted to receive said detonating cord, and a compressed explosive disposed between said detonator and said detonating cord within said second pressure tight housing, said explosive abutting against an end of said detonator and an end of said detonating cord and completely surrounding a periphery of said detonator and a periphery of said detonating cord, said second pressure tight housing of said transfer unit including penetration prevention means for preventing said detonating cord from penetrating said explosive when said detonating cord attempts to move longitudinally through the second housing toward said detonator.

7. The firing head of claim 6, wherein said penetration prevention means including a neck down portion surrounding a periphery of said explosive.

* * * * *